US005359181A

United States Patent [19]

Waechtler et al.

[11] Patent Number: 5,359,181

[45] Date of Patent: Oct. 25, 1994

[54] DEVICE FOR TRANSPORTING RECORDING MEDIA IN PRINTERS OR PHOTOCOPIERS

[75] Inventors: Rudolf Waechtler, Hohenpolding; Edmund Creutzmann, Markt Schwaben; Walter Kopp, Taufkirchen, all of Fed. Rep. of Germany

[73] Assignee: Siemens Informationssysteme Aktiengesellschaft, Paderborn, Fed. Rep. of Germany

[21] Appl. No.: 917,082

[22] PCT Filed: Dec. 4, 1990

[86] PCT No.: PCT/EP90/02089

§ 371 Date: Aug. 3, 1992

§ 102(e) Date: Aug. 3, 1992

[87] PCT Pub. No.: WO91/11755

PCT Pub. Date: Aug. 8, 1991

[30] Foreign Application Priority Data

Feb. 2, 1990 [EP] European Pat. Off. ..... 90102129.5

[51] Int. Cl.[5] ..... G03G 15/20

[52] U.S. Cl. ..... 219/216; 226/21; 355/290; 355/295

[58] Field of Search ..... 226/15, 18, 21; 355/282, 285, 289, 290, 295; 219/216, 469

[56] References Cited

U.S. PATENT DOCUMENTS

| | | | |
|---|---|---|---|
| 4,147,922 | 4/1979 | Naeser et al. | 219/216 |
| 4,753,543 | 6/1988 | Mochimaru et al. | 400/119 |
| 4,961,704 | 10/1990 | Nemoto et al. | 432/8 |

FOREIGN PATENT DOCUMENTS

| | | | |
|---|---|---|---|
| 1166754 | 5/1901 | Canada . | |
| 0002303 | 6/1979 | European Pat. Off. . | |
| 0031137 | 7/1981 | European Pat. Off. . | |
| 2717260 | 10/1978 | Fed. Rep. of Germany . | |
| 3814596 | 11/1988 | Fed. Rep. of Germany . | |
| 28151 | 5/1993 | Japan | 226/21 |
| 2128108 | 4/1984 | United Kingdom . | |

OTHER PUBLICATIONS

Xerox Disclosure Journal, vol. 6, No. 3 (May/Jun. 1981) "Loading For Roll Fuser with Centrally Supported . . . " T. Rengert.

IBM Technical Disclosure Bulletin, vol. 23, No. 7A (Dec. 1980) "Paper Edge Sensor" R. J. Perkins.

*Primary Examiner*—Benjamin R. Fuller
*Assistant Examiner*—J. E. Barlow, Jr.
*Attorney, Agent, or Firm*—Hill, Steadman & Simpson

[57] ABSTRACT

The device for transporting recording media (100), used especially in a fuser station of a printer or photocopier, comprises a counter-roll (201) and a feed roll (205), mounted movably relative to the counter-roll (201), between which rolls the recording medium (100) is transported by friction. Furthermore, a guide bar (214) is arranged in the manner of a balance beam with spacing parallel to the feed roll (205) and so as to be pivotable about an axis of rotation (216) relative to the feed roll (205). In order to press the feed roll (205) against the counter-roll in a force-compensating manner, as required, spring elements (218) are arranged on the guide bar (214) on both sides of the axis of rotation and are coupled to bearing elements (206) of the feed roll (205). The guide bar can be deflected via an adjusting motor (224) for controlling the position of the recording medium (100) between the rolls (201, 205).

10 Claims, 2 Drawing Sheets

DEVICE FOR TRANSPORTING RECORDING MEDIA IN PRINTERS OR PHOTOCOPIERS

BACKGROUND OF THE INVENTION

1. Field of the Invention

The invention relates to a device for transporting a recording medium in a printer or photocopier and to the use of a device of this type in a fuser station of a printer or photocopier.

2. Description of the Related Art

It is customary to use endless paper with transportation perforations in high speed non-mechanical printing apparatuses which operate by the electrophotographic or magnetic principle. In this case, the endless paper is withdrawn from a stack, transported through a transfer station with the aid of tractors engaging in the edge perforations and thereby coated with a layer of toner depending on the characters being printed. The layer of toner situated on the recording medium is then thermally fused in a fuser station, also termed a fixing station. A fuser station of this type is known, for example, from U.S. Pat. No. 4,147,922. For this purpose, the fuser station comprises in a customary manner an electric, heated fuser, or fixing roller and a feed roller which can be pivoted onto and away from the fuser roller. In this case, the recording medium must be guided precisely through the fuser station without movement relative to the fuser roller.

In order to prevent relative movement of this type, it has proved necessary to ensure an even pressing force of the feed roller onto the fuser roller along the length of the roller. With different pressing forces along the length of the roller, there is a risk of the web of paper migrating horizontally in the fuser station during the printing operation. This can lead to tensioning of the web of paper and, with high transport speeds, to a tear in the paper.

For the pivoting of a feed roller onto and away from a counter-roller in a fuser station, it is known from German Patent 27 17 260 to arrange the feed roller on links and to pivot the latter via cam disks. In this case, the counter-roller is mounted in a stationary manner.

If the feed roller is not guided and pivoted on precisely parallel to the counter-roller, different pressing forces act along the rollers. Although the elastic sheathing of the feed roller ensures a certain force compensation, it has been shown that this force compensation is not sufficient.

A fusing apparatus for photocopiers is known from European Published Application 0,002,303, which has a fuser roller and a feed roller which can be pivoted onto and away from the fuser roller. The feed roller is mounted so as to be pivotable in a support cage, on which an eccentric member engages. The pressing force of the feed roller onto the fuser roller is measured via an apparatus measuring the deflection of the support cage. By pivoting the eccentric, the pressing force of the feed roller along the fuser roller can be changed or adjusted. Pressing fluctuations of the feed roller onto the fuser roller can thus be compensated.

Furthermore, the recording media used can vary in thickness over their width, or the recording media serve as media for credit cards to be printed, etc.

Additionally, non-mechanical printing apparatuses can be designed in such a way that they can process webs of recording media of different widths. With these, it is necessary to design the fuser station with the rollers arranged therein in accordance with the greatest width of recording medium. Regions of the fuser roller or of the feed roller in the fuser station which do not come into contact with the recording medium heat up locally more intensely than the actual contact regions with the recording medium because the recording medium withdraws heat from the fuser roller in the fusing region during the fusing operation. This leads to a heat-dependent different diameter of the feed roller consisting of elastic material. As a result, the recording medium is deflected horizontally.

It has therefore proved favorable to monitor the lateral position of the recording medium precisely via a scanning apparatus when it enters the fuser station in order to be able to intervene, if necessary, in terms of control via a control arrangement.

However, the problem of the precise controllable guiding of recording media is not only present wish electrophotographic printers and photocopiers. Even with other printing apparatuses which operate, for example, with inking units, it is necessary to position the recording medium precisely, at least in the printing region.

For positioning the recording media in printing apparatuses, it is customary to use electrically adjustable mechanical guide elements in the paper duct of the printing apparatus, the scanning of the ACTUAL position of the recording media likewise taking place via mechanical contact elements.

For scanning the position of the recording media, it is known from the IBM Technical Disclosure Bulletin, Vol. 23, No. 7*a*, December 1980 and from European Patent 0 031 137 to use optoelectronic scanning apparatuses.

SUMMARY OF THE INVENTION

The object of the invention is therefore to provide a device for transporting recording media in printers or photocopiers having a roller arrangement with a counter-roller and a feed roller and a recording medium guided by friction between them, which device is designed in such a way that the feed roller rests on the recording medium or the counter-roller with an even pressing force along the length of the roller.

A further aim of the invention is to provide a device in which positioning of the recording medium between the rollers is possible.

The device is particularly suitable for installation in a fuser, or fixer, station of an electrophotographic printer or photocopier.

This object is achieved by a device for transporting recording media in printers or photocopiers having a) a counter-roller and a feed roller, mounted movably relative to the counter-roller, between which rollers the recording medium is transported by friction, one of the rollers being driven by an electric motor, b) lateral bearing elements for the rollers, c) a guide bar which is arranged in the manner of a balance bean with spacing parallel to the feed roller and so as to be pivotable about an axis of rotation relative to the feed roller, and d) spring elements which are coupled to the guide bar and the bearing elements of the feed roller and are arranged on both sides of the axis of rotation of the guide bar in order to press the feed roller against the counter-roller in a force-compensating manner, as required.

Alternately, a fuser station for an electrophotographic printer or photocopier for thermal fusing of a recording medium, bearing a toner image, includes a) a motor-driven, electrically heated fuser roller and a feed roller which can be pivoted onto and away from the fuser roller, between which rollers the recording medium is passed for fusing, b) lateral bearing elements for the feed roller, c) a guide bar which can be rotated in the manner of a balance beam about an axis of rotation perpendicular to the longitudinal extent of the feed roller, and d) spring elements, arranged on lateral arms of the guide bar, for force-compensating pressing of the feed roller onto the fuser roller via the bearing elements of the feed roller.

Advantageous embodiments of the invention are provided by the device having rotatably mounted links, coupled to the spring elements, having swivel arms for pressing the feed roller onto the counter-roller.

The device may further include eccentric elements which are arranged on the links and can be rotated via an adjusting motor and that are supported on the bearing elements of the feed roller for pivoting the feed roller onto and away from the counter-roller, a limiting stop assigned to the links, and a restoring spring coupled to the bearing elements of the feed roller, the above-mentioned elements being arranged relative to one another in such a way that, starting from a pivoted-away position, when the feed roller is pivoted on via the eccentric elements counter to the force effect of the restoring spring, the links rest on the limiting stop and thus absorb the spring force of the spring elements until the feed roller is supported on the counter-roller.

The eccentric apparatus of the foregoing embodiment may be cam disks.

The guide bar is coupled to an adjusting motor in order to deflect the guide bar about the axis of rotation into predeterminable deflection positions and thus to adjust the pressing force of the feed roller onto the counter-roller along its roller length, according to one development.

In the foregoing fuser station, links are mounted rotatably about a stationary axis of rotation for pressing the feed roller onto the fuser roller via the spring elements.

The fuser station, in one embodiment, may include eccentric elements which are arranged on the links and can be rotated via an adjusting motor and that are supported on the bearing elements of the feed roller, for pivoting the feed roller onto and away from the counter-roller, a limiting stop arranged in a stationary manner and assigned to the links, and a restoring spring coupled to the bearing elements of the feed roller, the above-mentioned elements being arranged relative to one another in such a way that, starting from a pivoted-away position, when the feed roller is pivoted on via the eccentric elements counter to the force effect of the restoring spring, the links rest on the limiting stop and thus absorb the spring force of the spring element until the feed roller is supported on the counter-roller.

In the fuser station, the eccentric elements are preferably cams.

One embodiment of the fuser station provides that the guide bar is coupled to a drive apparatus in order to deflect the guide bar about the axis of rotation into predeterminable deflection positions and thus to adjust the pressing forces of the feed roller onto the counter-roller along its roller length.

By the arrangement of a guide bar which is mounted in the manner of a balance beam and engages with spring elements on the bearing elements of the feed rollers, the feed rollers is pressed against the counter-roller with an even pressing force over the entire roller length. Any different pressing forces occurring are compensated. The recording medium is thus transported reliably and without distortion between the rollers. Displacements of the recording medium relative to the rollers are avoided. The device is thus especially suitable for fuser stations in electrophotographic printers and photocopiers in which a toner image is thermally fused on a recording medium.

In an advantageous embodiment of the device, the force-compensating effect can be influenced with the aid of an adjusting apparatus. It is thus possible to control the position of the recording medium between the rollers.

BRIEF DESCRIPTION OF THE DRAWINGS

Embodiments of the invention are illustrated in the drawings and are described in detail below by way of example.

DETAILED DESCRIPTION OF THE PREFERRED EMBODIMENTS

Figure 1:
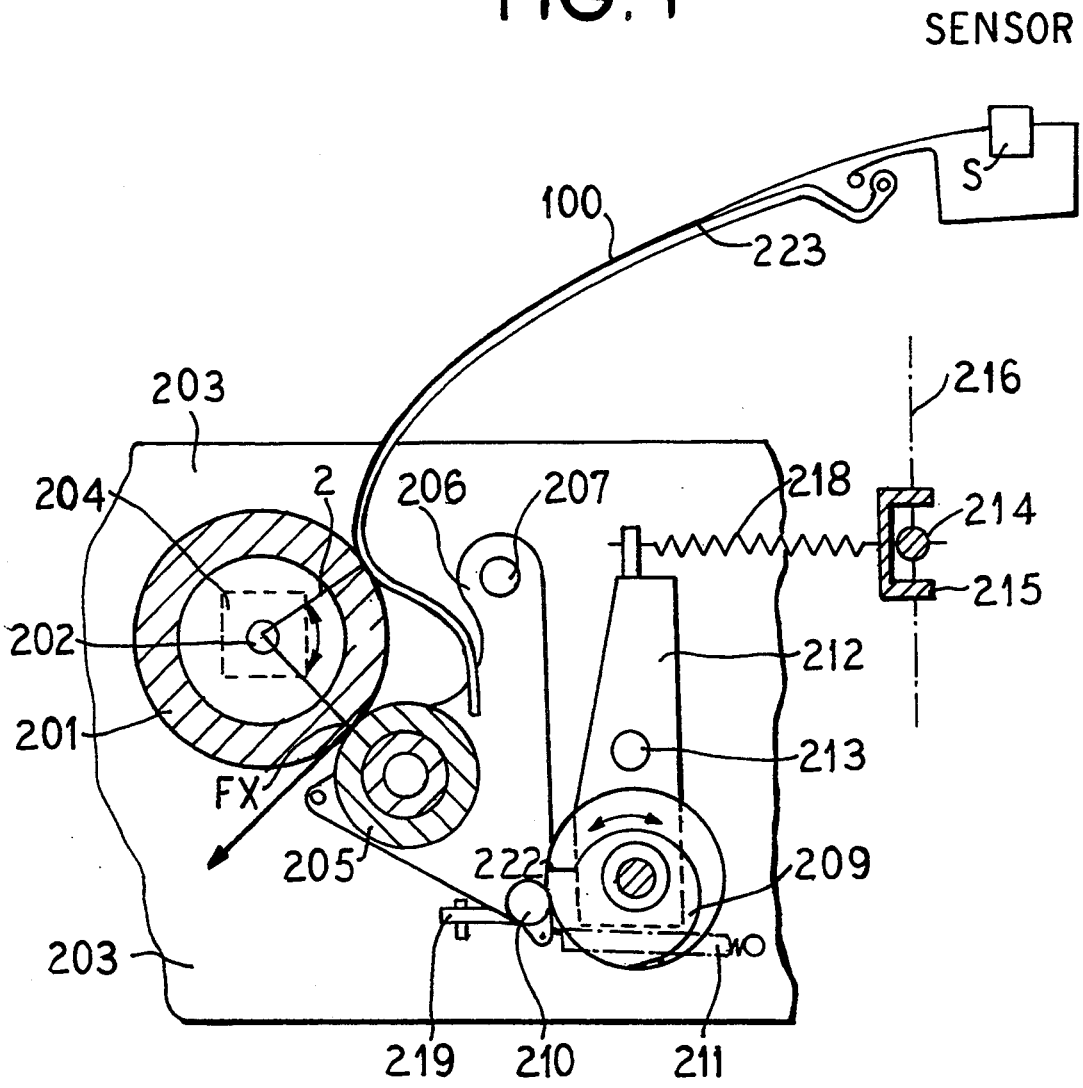
FIG. 1 is a diagrammatic sectional illustration of a fuser station of an electro-photographic printing apparatus with the transport device arranged therein.

A printing apparatus operating by the principle of electrophotography comprises a fuser, or fixer, station for fusing a toner image on the recording medium in the form of an endless web of paper 100. In this case, the recording medium 100 is subjected to heat and pressure in the fuser station and a firm bonding of the toner image with the recording medium is thus achieved. For thermal fusing, the fuser station comprises a fuser roller 201 with a heat radiator 202 arranged therein in the form of a halogen lamp. The fuser roller 201 is mounted on a frame 203 of the printer and is driven via a motor 204. The fuser roller 201 usually consists of a plastic-coated aluminum tube. A feed roller 205 made of a steel tube sheathed in rubber is mounted so that it can be pivoted onto and away from the fuser roller 201. The feed roller 205 is mounted on two lateral bearing elements 206. The bearing elements 206 are mounted in the frame 203 of the printer so as to be pivotable about a stationary axis of rotation 207. Arranged for pivoting the feed roller 205 onto and away from the fuser roller 201 acting as counter-roller are two cam disks 209 which can be rotated via an electric motor 208 (FIG. 2) and rest on guide attachments 210 (rotatable rollers) of the bearing elements 206. Two tension springs 211 engaging laterally on the bearing elements 206 serve as restoring springs for bearing elements 206 and press the bearing elements 206 against the cam disks 209 via the guide attachments 210. The cam disks 209 are mounted on lever-type links 212 with an axis of rotation 213 fixed in the frame 203 of the printing apparatus. Arranged spaced from and parallel to the feed roller is a guide bar 214 which is approximately as long as the feed roller. It is mounted pivotably in a bearing piece 215 approximately in the center of the feed roller, specifically about an axis 216 running approximately perpendicular to the longitudinal extent of the feed roller. The guide bar 214 has at its ends adjustable attachment elements (adjusting screws) 217, in which springs 218 connected to the links 212 are suspended. In conjunction with the centrally mounted guide bar 214, the springs 218 form a type of balance beam for force compensation of the pressing force of the feed roller 205 onto the fuser roller 201 over the length of the feed roller. Adjustable stops 219 for the cam disks 209 are arranged in the bearing region for limiting the swivel range of the links 212. The motor 208 is coupled to the cam disks via a cross-coupling 220. It allows pivoting of the cam disks 209 about the axis of rotation 213 corresponding to the direction of the arrow illustrated in FIG. 2 and thus movement relative to the motor 208 attached in a stationary manner via attachment elements (screws, etc. ) 221 to the frame 203 of the printing apparatus.

The spring force of the springs 218 is considerably greater than the spring force of the restoring springs 211 on the feed roller 205. In the pressed-on state (FIG. 1) of the feed roller 205, the links 212 are pivoted away from the stops 219. In accordance with their deflection, cam disks 209 press the feed roller 205 against the fuser roller 201. In this case, the pressing force is determined essentially by the spring force of the springs 218 in conjunction with the geometrical construction of the link 212 and the degree of deflection of the cam disks 209.

For pivoting away, the cam disks 209 are rotated back via the motor 208. As a result, first the link 212 moves under the effect of the spring force 218 without the feed roller 205 being pivoted away from the fuser roller 201, specifically until the links 212 rest with their lower pivot arms on the stops 219. As a result, the spring force of the spring elements 218 is absorbed. On further rotation of the cam disks 219 for pivoting the feed roller 205 away completely, the feed roller 205 is then raised from the fuser roller 201 under the effect of the restoring spring 211. In this actual pivoting-away operation, the bearing elements 206 rest via their attachments 210 on the cam disks 209. The pivoting-away range and thus the range of rotation of the cam disks 209 is limited by an attachment 222 on the cam disks which, with a complete revolution of the cam disks 209, rests on the guide attachments 210 of the bearing elements during pivoting-away. The feed roller 205 is thus in the pivoted-away state and the recording medium 100 can be threaded into the fuser station. The pivoting of the feed roller 205 onto the fuser roller 201 takes place in the opposite direction. In this case, the feed roller 205 is first brought to rest on the fuser roller 201 by rotation of the cam disks 209, specifically counter to the spring force of the restoring springs 211. On further rotation of the cam disks 209, the links 212 are raised from the stops 219 and the spring force of the springs 218 is fully effective. The balance beam-type construction of the pressing-on mechanism for the feed roller 205 with the guide bar 214 and spring elements 218 in conjunction with the links 212 ensures a force compensation of the pressing force of the feed roller 205 along the fuser roller 201 and thus an even fusing force on the recording medium 100. This is important for an even fusing result, especially when recording media 100 of different widths are used.

As already detailed at the beginning, the fuser station in the electrophotographic printing apparatus serves for fusing the toner image applied to the recording medium in a transfer station onto the recording medium 100 by heat and pressure. For this purpose, the recording medium 100 shown in FIG. 1 is brought to rest on the fuser roller 201 with its toner-layer side at the top via a fusing saddle 223 which can be pivoted on and away. It is wrapped around the fuser roller 201 at a wrapping angle Z and is heated up there (pre-heated). The actual fusing then takes place in a fusing gap, or fixing gap, FX, namely the pressing-on region between the fuser roller 201 and the feed roller 205. For fusing, the recording medium 100 has to be heated in the fusing region consisting of the wrapping angles Z and the fusing gap FX from room temperature to a fusing temperature of greater than 110° C. To achieve a good printing quality, it is therefore necessary to guide the recording medium 100 precisely in the fuser station.

It is customary to use recording media of different widths or different formats in electrophotographic printers or photocopiers. In order to be able to guarantee a continuous printing operation, the individual assemblies of the printing apparatus must be designed in such a way that switching over between various paper formats or various recording media widths is possible without prolonged cooling phases. For this reason, the fuser roller 201 and the feed roller 205 are designed in terms of their length for the widest possible recording media format. If a recording medium having a width which is less than the maximum possible recording media width is fused between the fuser roller 201 and the feed roller 205, the feed roller 205 is heated locally to a different degree. In the region of the recording medium, the heating is less than in the region of the feed roller 205 not covered by the recording medium since the recording medium absorbs and discharges heat during the fusing operation.

It has now been established that the different heating of the regions of the feed roller in recording media of different widths leads to a different expansion of the feed roller. This results in a different diameter of the feed roller 205 in the region of the recording medium and in the region not covered by the recording medium. This leads, in turn, to the recording medium being deflected horizontally in the fusing gap FX. Smearing of the toner image and thus disturbances in the printed image are the result.

Furthermore, a lateral deflection of this type of the recording medium leads to tensioning of the recording medium in the paper guides of the printing apparatuses. In this case, tearing of the paper can be the result.

It is therefore desirable to control the horizontal position of the recording medium 100 in the fusing gap FX during the fusing operation, specifically especially when recording media of different widths are used. In this case, the positioning itself takes place by changing the pressing force of the feed roller 205 onto the fuser roller 201 over the length thereof.

A prerequisite for the control is firstly the registration of the ACTUAL POSITION of the recording medium on entry of the recording medium 100 into the fuser station in the inlet region of the fusing saddle 223. Arranged there for this purpose is an optoelectronic sensor S which registers the lateral position of the recording medium 100 via its transportation holes. Commercially available optoelectronic scanners or even mechanical scanning elements or the like can be used as sensors S.

Figure 2:
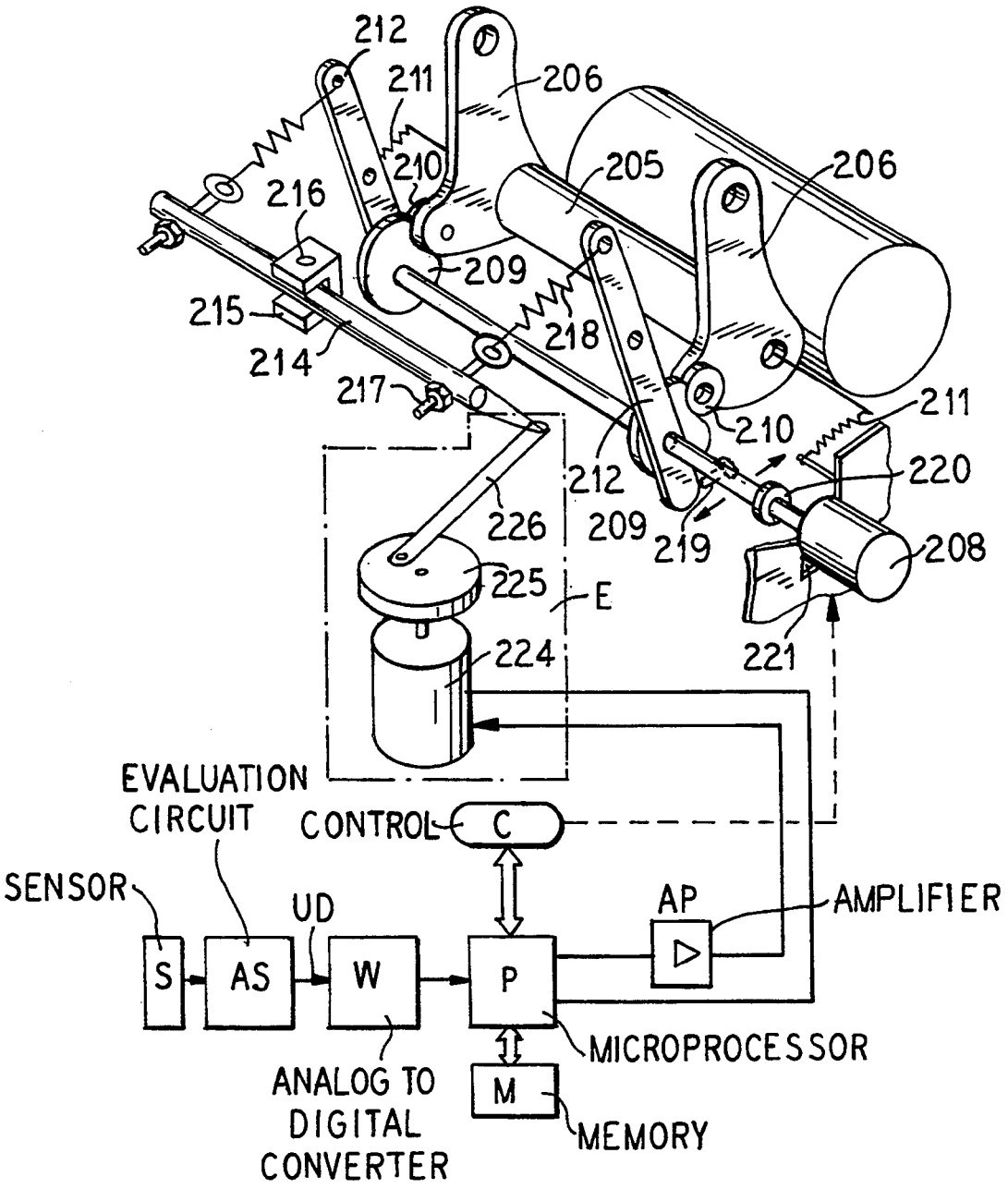
FIG. 2 shows a diagrammatic illustration of the fuser station of FIG. 1 with a block circuit diagram of a control arrangement for the lateral positioning of the recording medium.

The arrangement illustrated in FIG. 2 for the lateral positioning of the web-type recording medium 100 comprises a sensor S with an associated evaluation circuit AS for converting the sensor signals into position signals UD. Arranged downstream of the evaluation circuit AS is an analog-to-digital converter W which converts the position signals UD, supplied by the evaluation arrangement AS, into a digital signal so that the latter can be evaluated and processed with the aid of a microprocessor P. The microprocessor P is connected via a data bus to the actual control C of the printing apparatus. This control (equipment control) can be constructed, for example, in accordance with U.S. Pat. No. 4,593,407; a commercially available microprocessor (e.g. Siemens 8080 microprocessor) lends itself for use as microprocessor P. Additionally, microprocessor P is connected to a program memory M for receiving the control program.

The adjusting signals, supplied by the microprocessor P, are amplified via an amplifier AP and fed to the adjusting arrangement E for adjusting the pressing force of the feed roller 205 onto the fuser roller 201 along the fuser roller.

In the exemplary embodiment of FIG. 2, the apparatus E comprises an adjusting motor 224 with an eccentric disk 225 arranged thereon. However, any other adjustable electronic drive apparatus, e.g. a solenoid, is also suitable instead of an adjusting motor. The eccentric disk 225 is connected to the guide bar 214 via a linkage 226. By rotating the eccentric disk 225, the guide bar 214 is deflected to a varying extent around the axis of rotation 216 via the linkage 226 and thus the pressing force on the bearing elements 206 of the feed roller 205 is changed. The horizontal position of the recording medium can thus be adjusted in the fusing gap FX.

This adjustment takes place via the arrangement described for the lateral positioning by means of the microprocessor P which compares the ACTUAL position signals UD, supplied by the sensor S, with a reference position stored, for example, in the memory M and, as a function thereof, drives the adjusting motor 224 via the amplifier AP. The position of the adjusting motor 224, which can be registered, for example, via a scanning apparatus, is likewise fed to the microprocessor P for evaluation.

The position of the recording medium in the fuser station can be optimized via the control arrangement. In this case, the aim of control can be the so-called zero position of the endless paper, i.e. the positioning of the transportation perforations of the endless paper on a position assigned to the position above the dividing line of the sensor surfaces of the scanner. However, the aim of control can also be lead to the recording medium if, for example, initially very narrow paper is printed and then a change to wide paper is envisaged. In this case, the control arrangement takes into consideration the behavior of the recording medium to be expected the future and deflects the recording medium at a given time before or after changeover. The different behavior of the recording media and any necessary lead can be stored as a program within the memory M of the microprocessor arrangement.

The transport device described in connection with a fuser station of an electrophotographic printer with a counter-roller and feed roller can also be used for transporting recording media in other printing apparatuses or copying apparatuses. These recording media can be single sheets or as webs of endless paper.

If, instead of the tension springs 218, compression springs are used, these engage directly on the lower part of the lever-type links 212 in the vicinity of the cam disks 209. The stop 219 absorbing the spring force of the spring must be arranged on the upper part of the links 212 in an appropriate position.

Furthermore, it is possible, instead of the mechanism described for pivoting the feed roller 205 on and away, to have a simple pivoting-away lever with a catch mechanism, for example, on the feed roller 205 or to dispense completely with the pivoting away. The springs 218 of the guide bar then engage directly on the bearing element 206 of the feed roller 205, if they are constructed, for example, as compression springs, or via pivotable levers corresponding to the lever-type links 212.

Although other modifications and changes may be suggested by those skilled in the art, it is the intention of the inventors to embody within the patent warranted hereon all changes and modifications as reasonably and properly come within the scope of their contribution to the art.

We claim:

1. A device for transporting recording media in printers or photocopiers, comprising:

a) a counter roller and a feed roller mounted movably relative to the counter roller, between said rollers the recording medium is transported by friction, an electric motor connected to drive at least one of the rollers, b) lateral bearing elements on which said feed roller is mounted for rotation, means for supporting said counter roller for rotation, c) a guide bar mounted as a balance beam spaced from and parallel to said feed roller and so as to be pivotable about an axis of rotation relative to said feed roller, d) spring elements which are coupled to said guide bar and which bias said lateral bearing elements of the feed roller and are arranged on each side of the axis of rotation of said guide bar, and e) means for coupling said spring elements to said feed roller in order to press the feed roller against the counter roller in a force-compensating manner.

2. A device as claimed in claim 1, wherein said means for coupling comprises rotatably mounted links coupled to said spring elements and having swivel arms for pressing said feed roller onto said counter roller.

3. A device as claimed in claim 2, further comprising:

eccentric elements mounted on said rotatably mounted links, an adjusting motor connected for rotating said eccentric elements and said eccentric elements bearing on said bearing elements of said feed roller for pivoting said feed roller onto and away from said counter roller, a limiting stop mounted to selectively abut said rotatably mounted links, and a restoring spring coupled to said bearing elements of said feed roller so that, starting from a pivoted-away position, when said feed roller is pivoted via said eccentric elements counter to a force effect of said restoring spring, said rotatably mounted links rest on said limiting stop and thus absorb spring force of said spring elements until said feed roller is supported on said counter roller.

4. A device as claimed in claim 3, wherein said eccentric elements include cam disks.

5. A device according to claim 1, further comprising:

an adjusting motor coupled to said guide bar in order to deflect said guide bar about the axis of rotation into predeterminable deflection positions and thus to adjust pressing force of said feed roller onto said counter roller along its roller length.

6. A fuser station for an electrophotographic printer or photocopier for thermal fusing of a recording medium bearing a toner image, comprising:

a) a motor-driven, electrically heated fuser roller and a feed roller which is mounted to be pivotable onto and away from said fuser roller, between said rollers the recording medium is passed for fusing, b) lateral bearing elements on which said feed roller is rotatably mounted, c) a guide bar mounted to be rotated as a balance beam about an axis of rotation perpendicular to a longitudinal extent of said feed roller, and d) spring elements connected to lateral arms of said guide bar and having means for force-compensating pressing of said feed roller onto said fuser roller via said bearing elements of said feed roller.

7. A fuser station as claimed in claim 6, further comprising:

links mounted rotatably about a stationary axis of rotation so as to press said feed roller onto said fuser roller via said spring elements.

8. A fuser station as claimed in claim 7, further comprising:

eccentric elements connected on said links and rotatable via an adjusting motor and bearing against said bearing elements of said feed roller for pivoting said feed roller onto and away from said counter roller, a limiting stop mounted in a stationary position and selectively abutting said links, and a restoring spring coupled to said bearing elements of said feed roller so that, starting from a pivoted-away position, when said feed roller is pivoted via said eccentric elements counter to a force effect of said restoring spring, said links rest on said limiting stop and thus absorb a spring force of said spring element until said feed roller is supported on said counter roller.

9. A fuser station as claimed in claim 8, wherein said eccentric elements comprise cams.

10. A fuser station as claimed in claim 6, further comprising:

a drive apparatus to which said guide bar is coupled in order to deflect said guide bar about the axis of rotation into predeterminable deflection positions and thus to adjust pressing forces of said feed roller onto said counter roller along its roller length.

* * * * *